US006474125B1

(12) United States Patent
Denis et al.

(10) Patent No.: US 6,474,125 B1
(45) Date of Patent: Nov. 5, 2002

(54) HEMMING MACHINE WITH DUAL BALL SCREW DRIVE

(75) Inventors: Kenneth Saint Denis, Tecumseh (CA); Ray Cote, Windsor (CA); Louis Raffin, Windsor (CA); Lee Harrison, Windsor (CA)

(73) Assignee: Valiant Corporation (CA)

( * ) Notice: Subject to any disclaimer, the term of this patent is extended or adjusted under 35 U.S.C. 154(b) by 0 days.

(21) Appl. No.: 09/861,067

(22) Filed: May 18, 2001

(51) Int. Cl.[7] ..... B21D 5/16
(52) U.S. Cl. ..... 72/306; 72/386; 29/243.58
(58) Field of Search ..... 72/312, 306, 386, 72/454; 29/243.58, 243.57, 243.5

(56) References Cited

U.S. PATENT DOCUMENTS

| | | | | | |
|---|---|---|---|---|---|
| 1,288,648 | A | * | 12/1918 | Morgan | 72/454 |
| 2,983,159 | A | * | 5/1961 | Zeligowsky | 100/214 |
| 3,422,658 | A | * | 1/1969 | Michelson | 72/454 |
| 5,454,261 | A | | 10/1995 | Campian | 72/384 |
| 5,488,880 | A | | 2/1996 | Sartorio | 74/424.8 B |
| 5,669,296 | A | | 9/1997 | Newton | 100/99 |
| 5,930,880 | A | * | 8/1999 | Toeniskoetter | 100/271 |
| 6,154,942 | A | * | 12/2000 | Toeniskoetter | 29/243.58 |
| 6,182,492 | B1 | | 2/2001 | Raffin et al. | 72/454 |

* cited by examiner

*Primary Examiner*—Daniel C. Crane
(74) *Attorney, Agent, or Firm*—Gifford, Krass, Groh, Sprinkle, Anderson & Citkowski, P.C.

(57) ABSTRACT

A hemming machine for sheet metal is disclosed having a base adapted to be supported on a ground support surface. A cradle is vertically slidably mounted to the base while a nest is mounted to the cradle and adapted to support the part to be hemmed. Hemming tooling is mounted to the base and movable between an extended position in which the hemming tooling overlies the nest, and a retracted position in which the hemming tooling is spaced laterally outwardly from the nest. A pair of spaced ball screws are rotatably mounted to the base and threadably connected to the cradle on opposite sides of the nest so that rotation of the ball screws vertically displaces the cradle relative to the base. A single drive motor is drivingly connected through a two speed gear box to both ball screws to rotatably drive the ball screws in synchronism with each other.

19 Claims, 7 Drawing Sheets

HEMMING MACHINE WITH DUAL BALL SCREW DRIVE

BACKGROUND OF THE INVENTION

I. Field of the Invention

The present invention relates generally to a hemming machine for sheet metal.

II. Description of the Prior Art

There are many previously known hemming machines for producing a sheet metal hem between two parts. Such hemming machines are frequently employed in the automotive industry as well as other industries.

These previously known hemming machines typically comprise a stationary base having a nest vertically slidably mounted to the base. The nest is dimensioned to support the part to be hemmed while actuators, typically hydraulic actuators, vertically displace the nest with its supported part.

In order to perform the hem, hemming tooling is mounted to the base and movable between an extended position and a retracted position. In its extended position, the hemming tooling overlies the nest while, conversely, in its retracted position, the hemming tooling is spaced laterally outwardly from the nest to allow the part as well as the nest to move vertically past the tooling.

Conventionally, these previously known hemming machines perform both a prehem and a final hem so that the hemming tooling contains two sets of tooling. The prehem tooling typically bends the sheet metal part to approximately 45° while the final tooling to perform the final hem compresses the hems flatly against each other.

There have, however, been a number of disadvantages of these previously known hemming machines. A primary disadvantage is that the hydraulic actuators were required to displace the nest with its supported part between the prehem and final hem positions. Such hydraulic actuators, however, are prone to leakage and thus create workplace hazards.

A still further disadvantage of these previously known hemming machines is that, in the event that the nest and/or base deflects during the operation of the hemming machine, accurate positioning of the hemming tooling with respect to the nest is difficult to maintain. Unless the hemming tooling is accurately positioned relative to the nest, inaccuracies in the hemmed part will result.

SUMMARY OF THE PRESENT INVENTION

The present invention provides a hemming machine which overcomes all of the above-mentioned disadvantages of the previously known devices.

In brief, the hemming machine of the present invention comprises a stationary base which is supported on a ground support surface. A cradle is vertically slidably mounted to the base while a nest is mounted to the cradle. The nest, in turn, supports the part to be hemmed.

Hemming tooling is also mounted to the base and movable between an extended position and a retracted position. In its extended position, the hemming tooling overlies the nest and thus the part to be hemmed. Conversely, in its retracted position, the hemming tooling is spaced laterally outwardly from the nest so that both the nest as well as the part carried by the nest can be vertically moved past the hemming tooling. Typically, the hemming tooling includes both prehem tooling which forms a substantially 45° bend as well as the final hem tooling which flatly compresses the material around the hem together.

In order to vertically displace the cradle and thus the nest with its supported part, a single electric motor is drivingly connected to a set of two ball screws. In the preferred embodiment of the invention, a gear box is associated with each ball screw while a drive shaft extending from the electric motor is drivingly connected to each gear box so that, upon rotation of the single drive motor, the rotation of the two ball screws are automatically mechanically synchronized. Rotation of the drive motor in a first direction vertically elevates the cradle and nest while, conversely, rotation of the drive motor in the opposite direction vertically lowers the cradle and nest.

In the preferred embodiment of the invention, a two speed gear box is mechanically connected between the drive motor and the drive shaft which, in turn, is connected to the ball screws via their associated gear boxes. The two speed gear box at the output of the electric motor thus enables the cradle with its nest and supported part to be rapidly and vertically moved between the vertical positions just prior to the prehem and final hem operations. When either a prehem or final hem operation is desired, the gear box drivingly connected with the motor is switched to slow speed thus enabling the drive motor to compress the part to be hemmed against the hemming tooling at high torque in order to perform the hem.

The cradle is preferably formed by a spaced apart beam assembly having a connected portion at each end. The ball screws are threadably connected with the connected portion at each end of the cradle. This construction for the cradle thus minimizes the overall hemmer height, as well as the cradle weight and thus the required output from the drive motor while still maintaining sufficient rigidity to accurately perform the hemming operation.

In order to compensate for slight deflection of the cradle and/or base during the operation of the hemming machine, a tapered pin is connected to each set of hemming tooling. This tapered pin is received within a socket formed on the nest during upward movement of the nest from a position just prior to the hemming operation, whether prehem or final hem, and to the hemming operation. Consequently, the cooperation between the pin and socket laterally displaces the hemmling tooling relative to the base to ensure that the hemming tooling is accurately positioned with respect to the nest and thus with respect to the part supported by the nest during the prehem and final hem operation.

BRIEF DESCRIPTION OF THE DRAWING

A better understanding of the present invention will be had upon reference to the following detailed description, when read in conjunction with the accompanying drawing, wherein like reference characters refer to like parts throughout the several views, and in which.

DETAILED DESCRIPTION OF PREFERRED EMBODIMENTS OF THE PRESENT INVENTION

Figure 1:
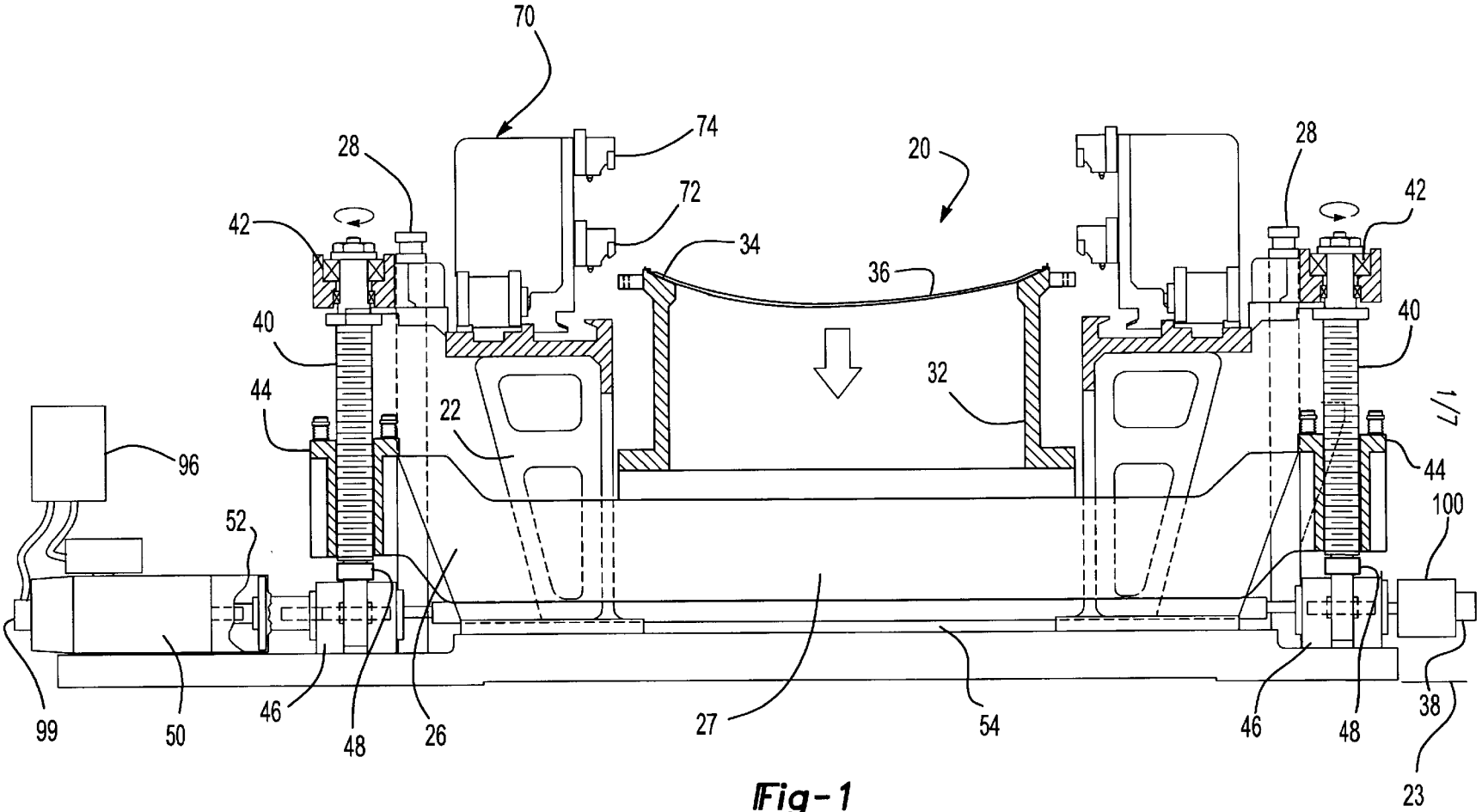
FIG. 1 is a side view illustrating a preferred embodiment of the present invention.
Figure 2:
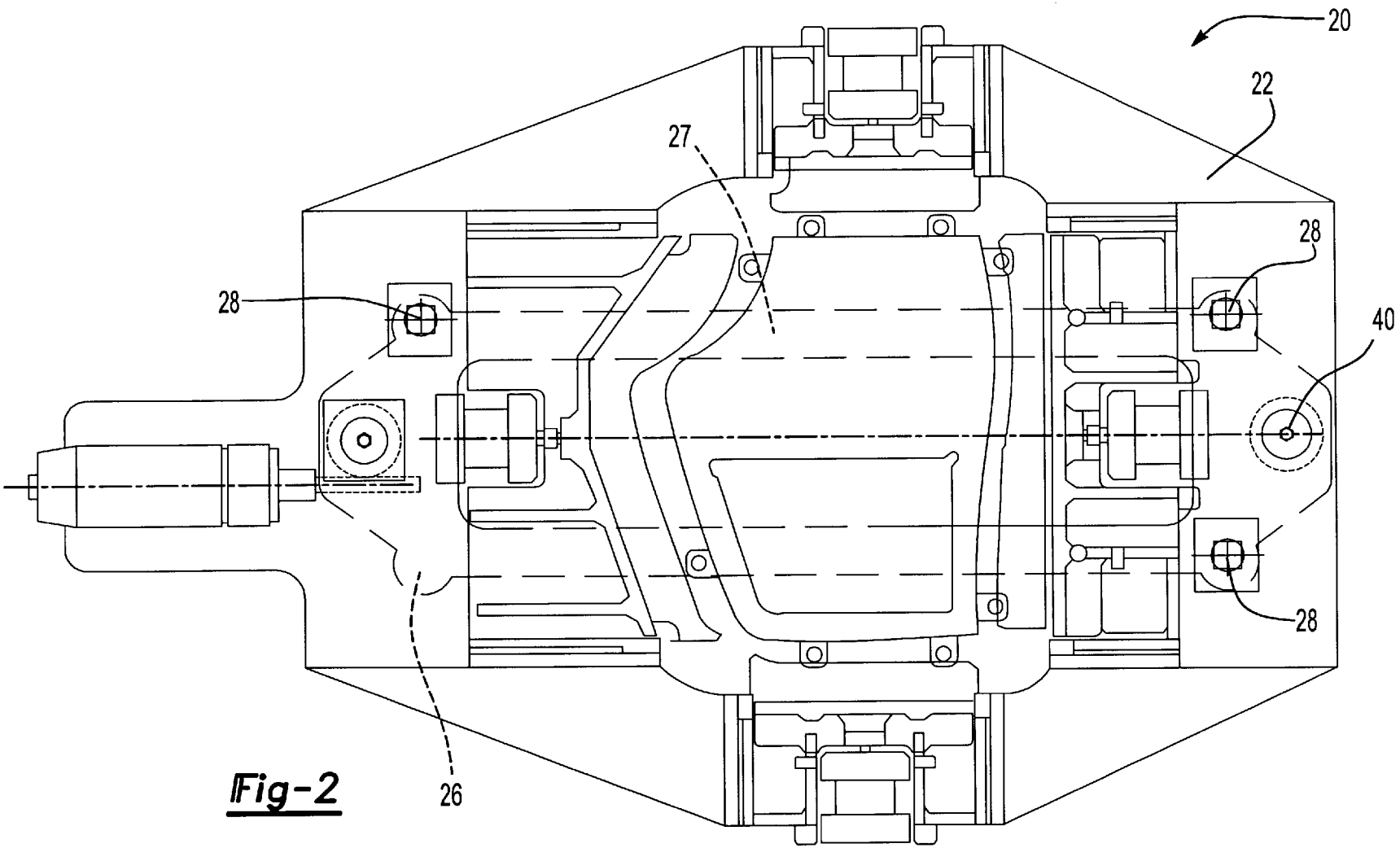
FIG. 2 is a top plan view illustrating the preferred embodiment of the present invention.

With reference first to FIGS. 1 and 2, a preferred embodiment of the hemming machine 20 of the present invention is there shown. The hemming machine 20 includes a stationary base 22 which is supported on a ground support surface 23 (FIG. 1).

A cradle 26 is vertically slidably mounted to the base 22 such that the cradle 26 is vertically movable relative to the base 22. A plurality of guide rods 28 are secured to the base 22 and extend through appropriate openings in the cradle 26 to guide the cradle 26 as the cradle 26 vertically moves relative to the base 22.

As best shown in FIG. 2, the cradle 26 preferably comprises a pair of spaced apart beams 27 having a connected portion 30 at each end of the beams 28. The beams 27 are preferably steel I beams with additional cross supports to rigidify the cradle 26.

With reference again to FIG. 1, a nest 32 is secured to the cradle 26 so that the nest 32 moves in unison with the cradle 26. The nest 32 includes an upper surface 34 configured to support a part 36 to be hemmed during the hemming operation. The part 36 can comprise, for example, an automotive door panel.

In order to vertically move the cradle 26, and thus the nest 32 with its supported part 34 relative to the base 22, a pair of ball screws 40 are rotatably mounted to the base 22 by thrust bearing assemblies 42 laterally outwardly from opposite sides of the nest 32. These ball screws 40 are, in turn, threadably connected to the cradle 26 by an internally threaded nut 44 so that rotation of the ball screws 40 in one direction vertically moves the cradle 26 upwardly relative to the base 22 while, conversely, rotation of the ball screws 40 in the opposite direction moves the cradle 26 vertically downwardly relative to the base 22.

Figure 5:
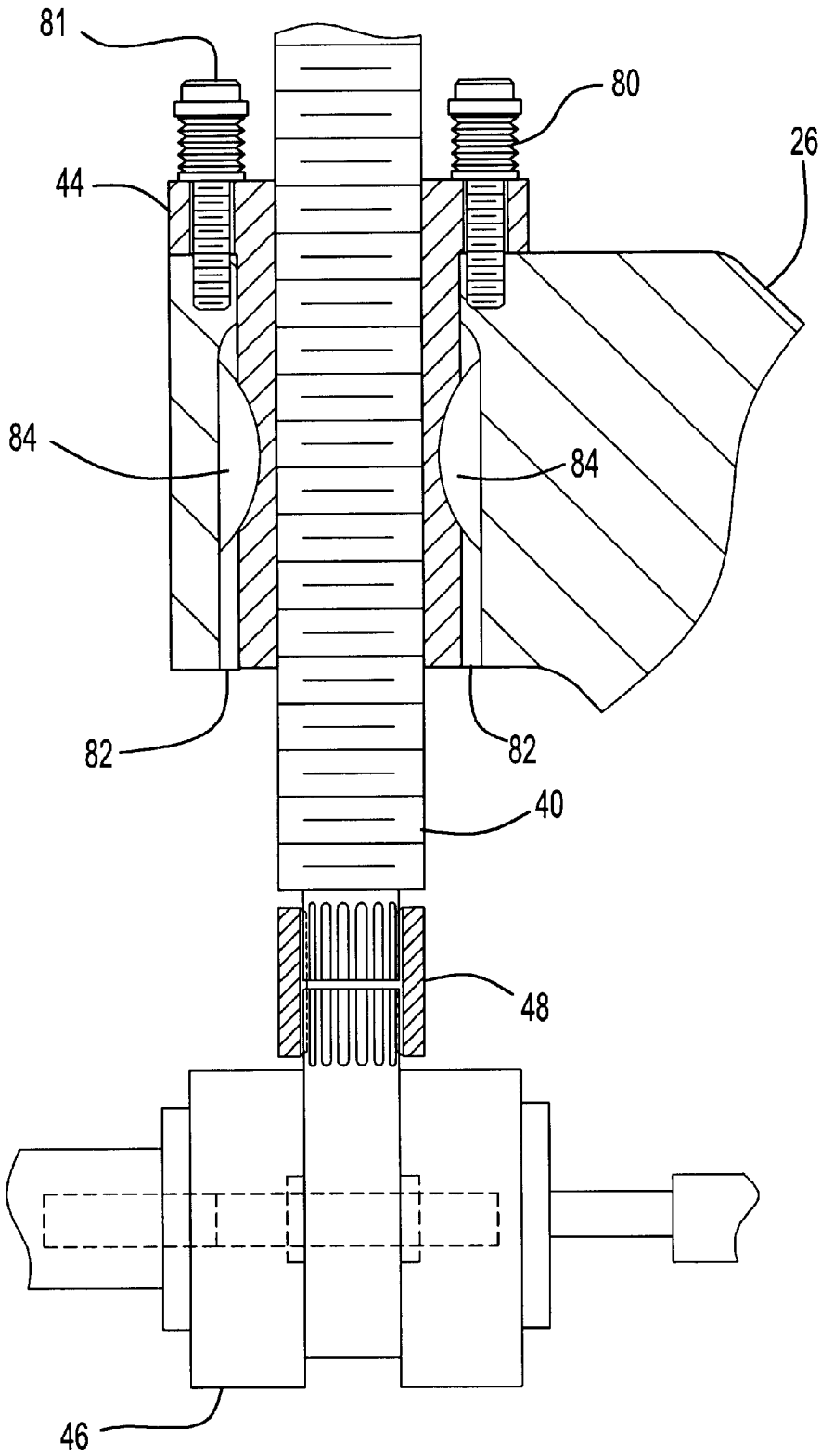
FIG. 5 is an enlarged fragmentary view illustrating a still further portion of the preferred embodiment of the present invention.

Referring to FIGS. 1 and 5, a drive gear box 46 is associated with each ball screw 40 and positioned underneath its associated ball screw 40. Each drive gear box 46 is mechanically connected to its associated ball screw through a gear coupling 48 (FIG. 5) so that output rotation from each drive gear box 46 rotatably drives its associated ball screw 40. In the well known fashion, the gear couplings 48 permit small deflections of its associated ball screw 40 relative to the drive gear box 46 so that a further description thereof is unnecessary.

Figure 3:
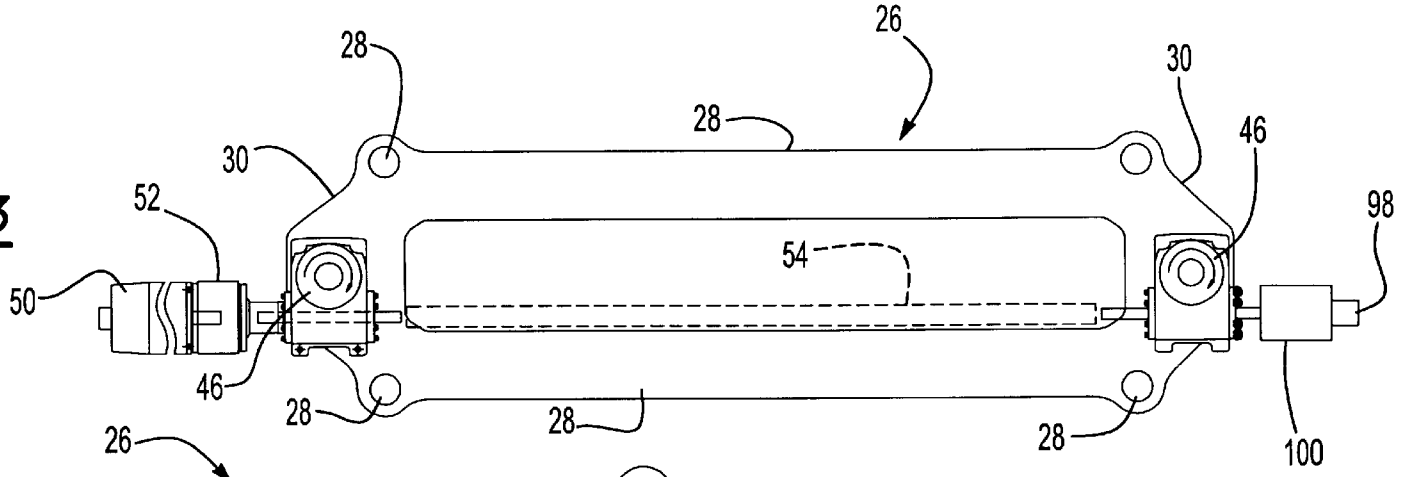
FIG. 3 is a top plan view illustrating a first preferred embodiment of the drive mechanism of the preferred embodiment of the present invention.

As best shown in FIG. 3, in order to rotatably drive the gear boxes 46, and thus rotatably drive the ball screws 40 in synchronism with each other, an electric drive motor 50 has its output connected through a two speed gear box 52 to one gear box 46. An elongated drive shaft 54 then drivingly connects the output from the two speed gear box 52 to the other gear box 46 such that the gear boxes 46 are rotatably mechanically driven in synchronism with each other by the motor 50 via the gear box 52.

Figure 4:
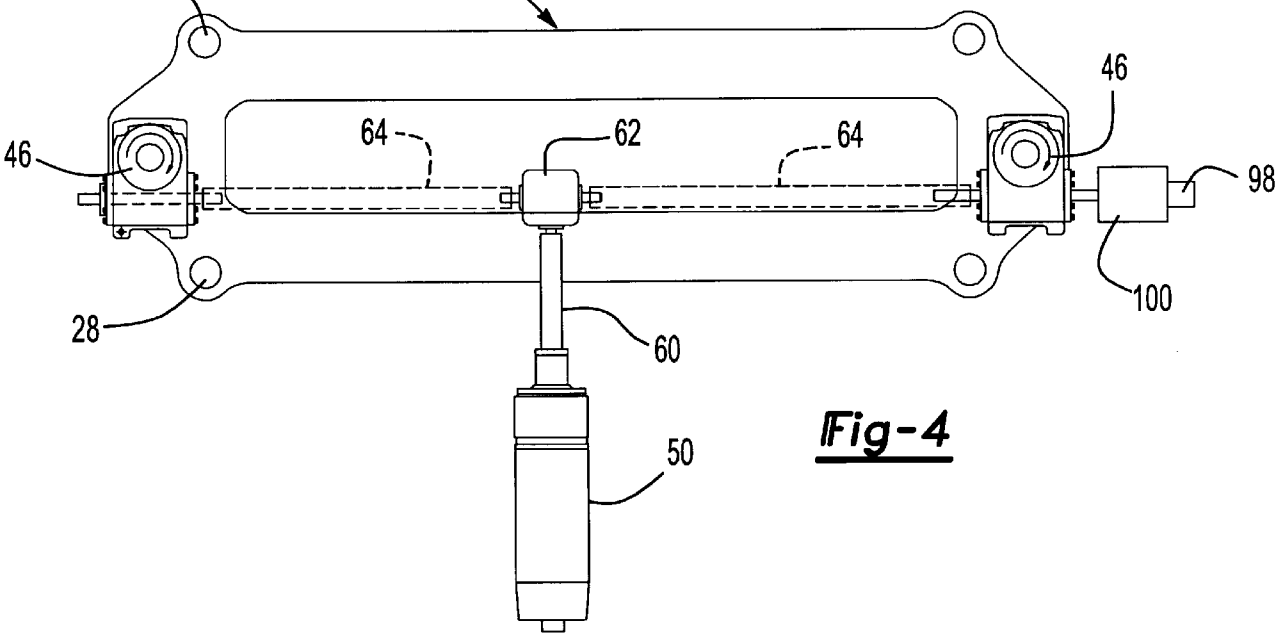
FIG. 4 is a view similar to FIG. 3, but illustrating a modification thereof.

With reference now to FIG. 4, a modification of the drive system is there shown in which the drive motor 50 drivingly connects a stub axle 60 through the two speed gear box 52. The stub axle 60 is, in turn, connected to the input of a bevel gear box 62. The bevel gear box 62 includes two output shafts each of which is mechanically connected by a shaft segment 64 to one of the gear boxes 46. Consequently, the bevel gear box 62 ensures that both gear boxes 46 are driven in synchronism with each other. A potential advantage of the drive system shown in FIG. 4, however, is that any deflection of the drive shafts 64 are evenly distributed between the gear boxes 46.

Referring again to FIGS. 1, 6 and 7, a hemming tooling assembly 70 is laterally slidably mounted to the base 22 and typically contains both prehemming tooling 72 as well as final hem tooling 74. The hemming tooling 70 is movable between a retracted position, illustrated in FIG. 6, and an extended position, illustrated in FIG. 6. In its retracted position (FIG. 6) the prehem tooling 72 and final hem tooling 74 is spaced laterally outwardly from the nest 32 to allow vertical displacement of the nest 32 with its supported part 36 past the tooling 72 and 74. Conversely, in its extended position (FIG. 7), the hemming tooling 72 and 74 overlies the nest 32 and thus the part to be hemmed 36. Any conventional means, such as a pneumatic or electrical actuator 71 (FIG. 6), can be utilized to move the hemming tooling assemblies 70 between their extended position and retracted position.

With reference again to FIG. 5, during vertical movement of the cradle 26, especially during the hemming operation, some deflection of the cradle 26 relative to the ball screws 40 is anticipated. Consequently, as best shown in FIG. 5, the nut 44 which threadably mounts the ball screws 40 to the cradle 26 is preferably secured to the cradle 26 by a plurality of spring washers 80, such as Belleville washers and bolts 81. Additionally, a clearance space 82 is provided between the outer surface of the nut 44 and the cradle 26. The cradle 26 and bearing 44, however, are secured together against relative rotation by at least one, and preferably two keys 84. The clearance space between the nut 44 and cradle 26 together with the springs 80 for securing the nut 44 to the cradle thus enables limited lateral deflection of the cradle 26 relative to the ball screws 40.

Figure 6:
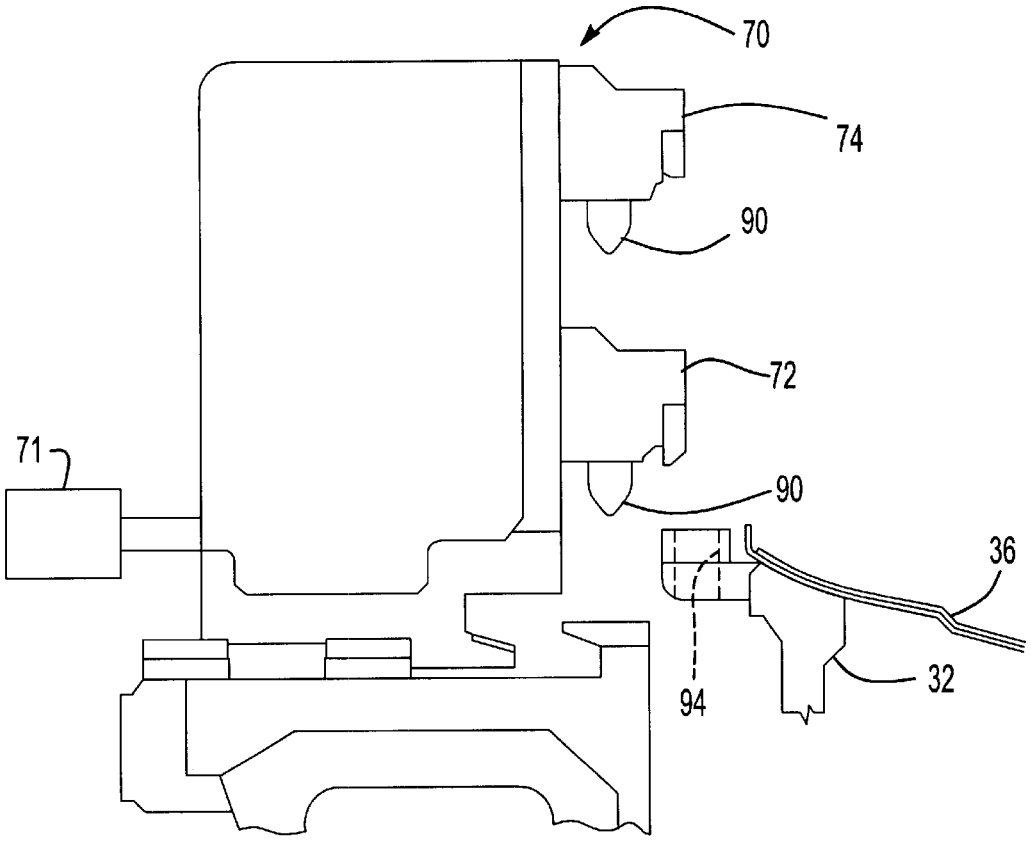
FIGS. 6–13 are side fragmentary enlarged views illustrating the operation of the preferred embodiment of the present invention.
Figure 7:
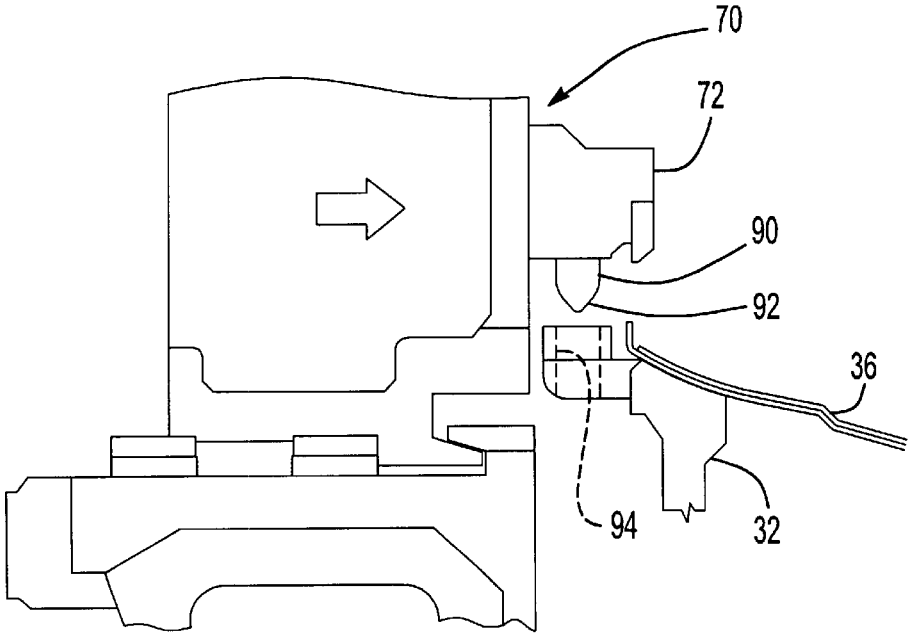
Figure 8:
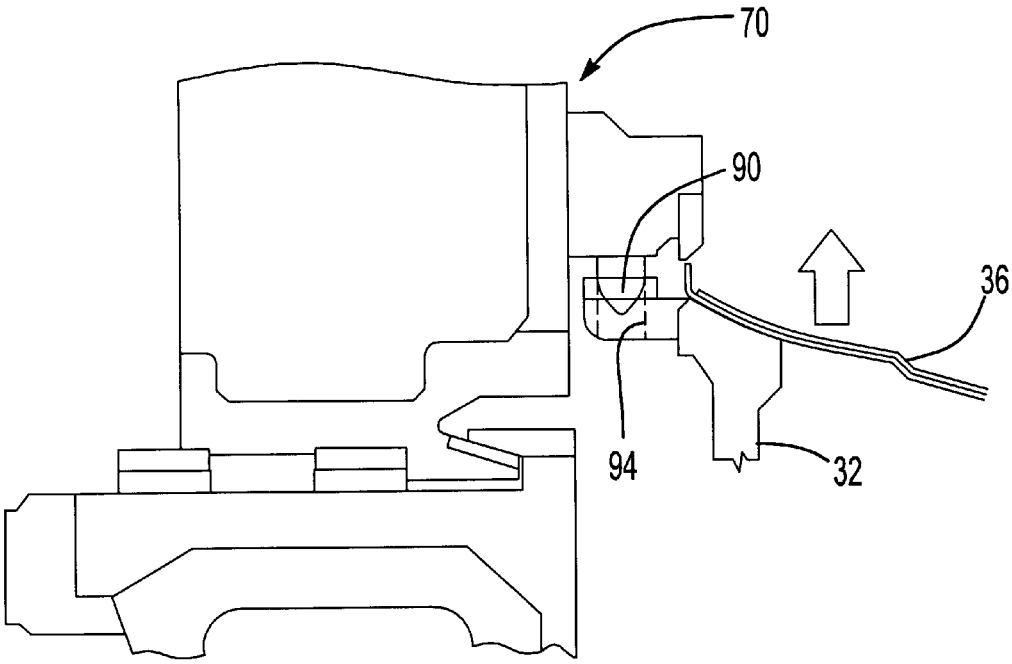
Figure 9:
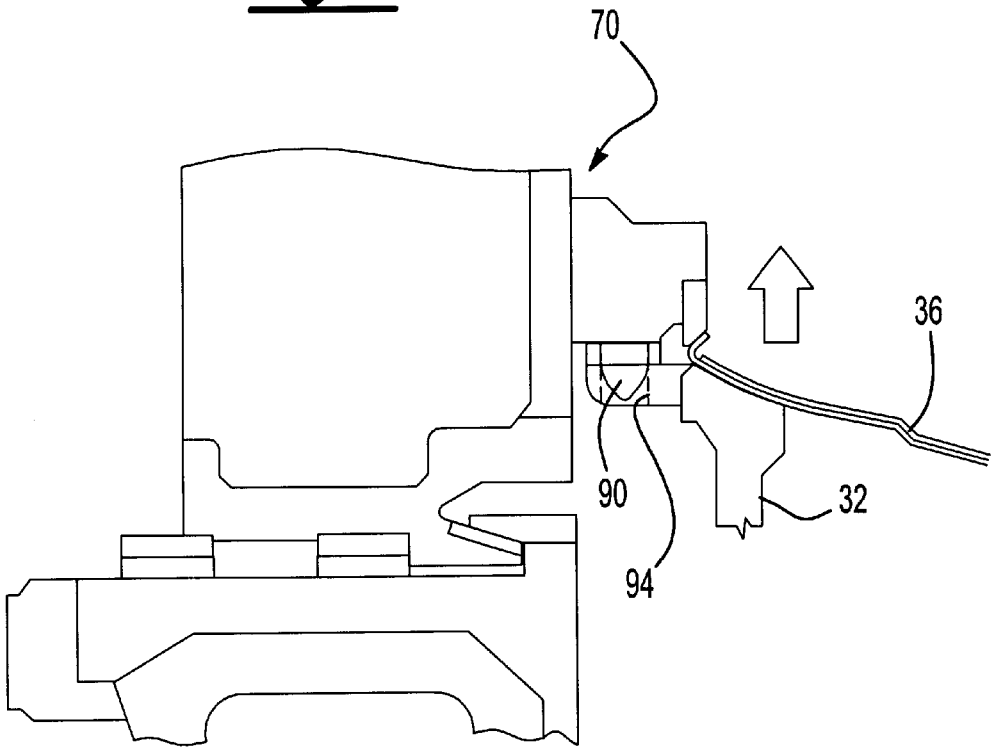

With reference now to FIGS. 6–9, a pair of downwardly extending pin 90 having a lower tapered portion 92 is secured at each side to both the final hem tooling 74 and prehem tooling 72. A pair of sockets 94 in turn is secured to each side of the nest 32 which registers with the lower end of the pin 90 as the nest 32 is moved in preparation for either a final hem or prehem operation as shown in FIG. 7. Consequently, upon movement of the nest 32 from the position shown in FIG. 7 to the position just prior to the prehem or final hem shown in FIG. 8, the tapered head 92 of the pin 90 enters the socket 94 on the nest 32 such that the nest 32 precisely laterally aligns the hemming tooling assembly 70 relative to the nest 32, and thus relative to the part 36. The cooperation between the alignment pins 90 and their associated sockets 94 thus ensures that the hemming tooling assembly 70 is precisely aligned to the nest 32 during both the prehem and final hem operations (FIG. 8).

With reference again to FIG. 1, a control circuit 96 (illustrated only diagrammatically) is associated with the hemming machine 20 to control the activation of the drive motor 50, the operation of the two speed gear box 52, as well as the movement of the hemming tooling assembly 70 between its extended and its retracted position by the actuators 71. The control system 96 receives as an input signal the output signal from an absolute shaft encoder 98 which is indicative of the precise rotational position of the ball screws 40 and thus the precise vertical position of the cradle 26 and nest 32. The control circuit also receives an input signal from a shaft position encoder 99 associated with the drive motor 50. The control system 96 also controls the actuation of a shaft brake 100 operatively coupled with the drive shaft 54 to momentarily lock the drive shaft 54 against rotation as the two speed gear box 52 is actuated between its slow speed and high speed positions.

The component parts having been described, the operation of the hemming machine 20 is as follows with reference particularly to FIGS. 6–13. As shown in FIG. 6, with nest 32 supporting a part to be hemmed 36 and the hemming tooling assembly 70 in its retracted position, the motor 50 is actuated by the control circuit 96 with the gear box positioned in its high speed position to move the nest 32 to a position beneath the prehem tooling 72. The control circuit 96 then actuates the actuator 71 for the hemming tooling assembly 70 to move the hemming tooling assembly 70 so that the prehem tooling 72 overlies the nest 36 as shown in FIG. 7. The control circuit 96 then actuates the motor 50 to move the cradle 26 and nest 32 to the position shown in FIG. 8 just prior to the prehem operation. In doing so, the sockets 94 on the nest 32 engage the tapered pins 90 on the prehemming tooling 72 to precisely align the prehemming tooling 72 relative to the nest 32.

The control circuit 96 then actuates the brake 100 and then switches the two speed gear box 52 to its low speed high torque position. The control circuit 96 then releases the brake 100 and actuates the motor 50 to move the cradle 26 and nest 32 to the position shown in FIG. 9 thus performing the prehem operation.

Figure 10:
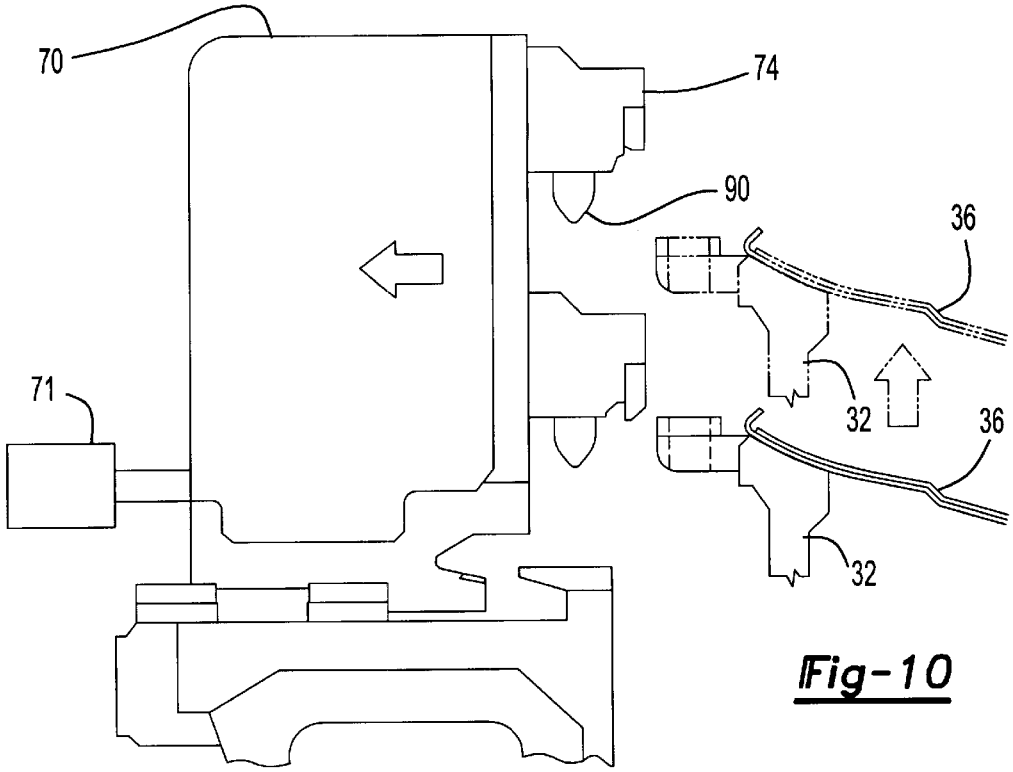
Figure 11:
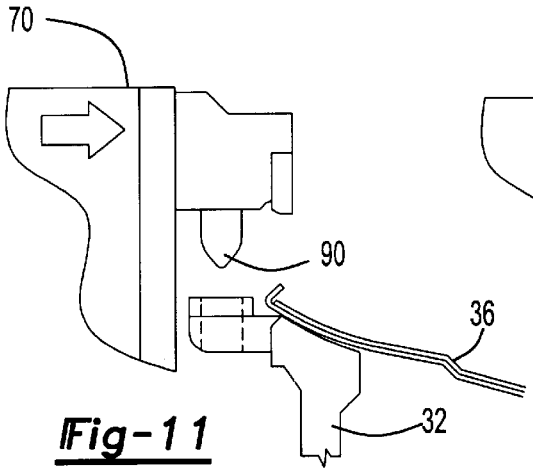
Figure 13:
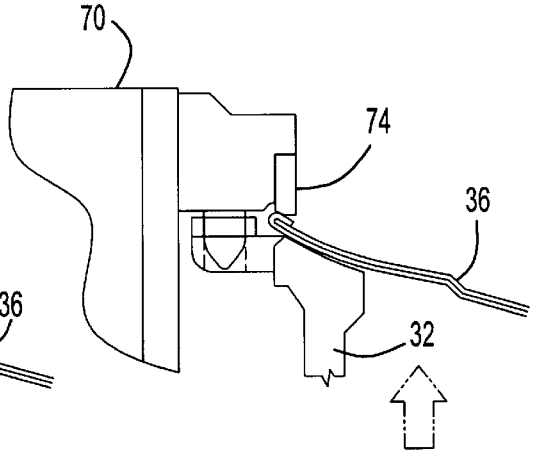
Figure 12:
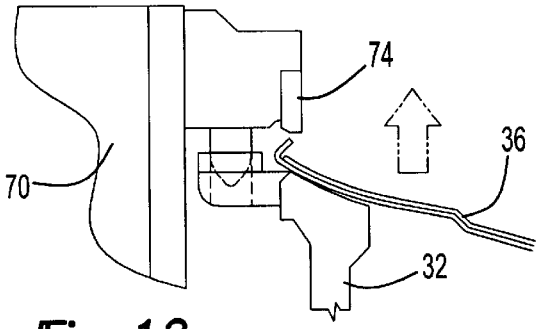

After the prehem operation, the hemming tooling 70 is moved to its retracted position as shown in FIG. 10 and the control circuit 96 actuates the brake 100 and again switches the gear box 52 to its high speed position. The control circuit 96 then actuates the motor 50 to move the cradle 26 and nest 32 to the position illustrated in phantom line in FIG. 10 in which the nest is positioned just below the final hemming tooling 74 an d the hemming tooling assembly 70 is moved to its extended position as shown in FIG. 11. As before, the tapered pins 90 associated with the final hemming tooling 74 cooperate with the sockets 94 on the nest 32 to precisely align the final hemming tooling 74 relative to the nest 32 as the nest 32 is moved to the position shown in FIG. 12 just prior to the final hem operation.

As before, the control circuit 96 then actuates the brake 100, switches the two speed gear box 52 to its low speed, and then disengages the brake 100. The control system 96 then again activates the drive motor 50 thus driving the nest 32 to the position shown in FIG. 13 in which the part 36 is compressed against the final hem tooling 74 thus completing the hem. The control system 96 then moves the hemming tooling 70 to its retracted position, the now hemmed part 36 is removed and replaced by a new unhemmed part, and the above process is repeated.

It will, of course, be appreciated that the use of the two speed gear box 52 mechanically coupled to the output from the drive motor 50 enables the cradle 26 and nest 32 to be rapidly moved between the positions just prior to the prehem and final hem operations in order to minimize cycle time for the hemming machine 20. However, by switching the two speed gear box 52 to low speed during the actual prehem and final hem operations, the motor 50 generates sufficient torque to perform the prehem and final hem operations while minimizing the power requirements for the drive motor 50.

Furthermore, during the hemming operation, a great deal of torque is applied to the cradle and nest 32. This torque results in slight deflection of the cradle 26. However, since a floating nut 44 is provided between the cradle 26 and the ball screws 40, slight deflection of the cradle 26 is accommodated without damage to the hemming machine.

Having described my invention, however, many modifications thereto will become apparent to those skilled in the art to which it pertains without deviation from the spirit of the invention as defined by the scope of the appended claims.

We claim:

1. A hemming machine comprising:

a base adapted to be supported on a ground support surface, hemming tooling mounted to said base, a cradle vertically slidably mounted to said base, a nest mounted to said cradle, said nest adapted to support a part to be hemmed, a first and second ball screw rotatably mounted to said base, said ball screws being threadably connected to said cradle on opposite sides of said nest so that rotation of said ball screws vertically displaces said cradle relative to said base, a single drive motor drivingly connected to both said first and second ball screws which rotatably drives said shafts in synchronism with each other, a control system which controls the activation of said motor, a first position transducer operatively coupled to said first bull screw, said first position transducer providing an output signal indicative of the rotational position of said first ball screw, and a second position transducer operatively coupled to said second ball screw, said second position transducer providing an output signal indicative of the rotational position of said second ball screw, said output signals from said transducers being connected as input signals to said control system.

2. The invention as defined in claim 1 wherein said drive motor comprises an electrically powered servo drive motor.

3. The invention as defined in claim 1 and comprising a first and second gear drive box, said first gear drive box being operatively disposed between said base and said first ball screw, said second gear drive box being operatively disposed between said base and said second ball screw, a shaft assembly extending between said gear boxes for rotatably driving said gear boxes in unison with each other, said motor being drivingly connected to said shaft assembly.

4. The invention as defined in claim 3 wherein said shaft assembly comprises a pair of aligned shaft segments, each shaft segment having a free end drivingly connected to one of said gear boxes, said motor being drivingly connected to the other ends of said shaft segments.

5. The invention as defined in claim 2 and comprising a multi-speed drive gear box and a drive shaft assembly drivingly connected between said motor and said ball screws.

6. The invention as defined in claim 5 wherein said multi-speed drive gear box comprises a two speed drive gear box.

7. The invention as defined in claim 5 and comprising a holding brake operatively connected to said motor.

8. The invention as defined in claim 1 and comprising a control system which controls the activation of said motor, a first position transducer operatively coupled to said first ball screw, said first position transducer providing an output signal indicative of the rotational position of said first ball screw, and eventually a second position transducer operatively coupled to said second ball screw, said second position transducer providing an output signal indicative of the rotational position of said second ball screw, said output signals from said transducers being connected as input signals to said control system.

9. The invention according to claim 1, wherein said position transducer is a multi-turn absolute encoder.

10. The invention as defined in claim 1 and comprising means for movably mounting said hemming tooling to said base between an extended position in which said tooling overlies said nest, and a retracted position in which said tooling is spaced outwardly from said nest, and means interacting between said nest and said hemming tooling for moving said hemming tooling to a preset extended position upon vertical movement relative to said hemming tooling.

11. The invention as defined in claim 10 wherein said interacting moving means comprises at least one pin on one of said nest and said hemming tooling and at least one socket on the other of said nest and said hemming tooling, said at least one pin engaging said at least one socket upon vertical movement of said nest relative to said hemming tooling.

12. The invention as defined in claim 11 wherein said at least one pin includes a tapered portion.

13. The invention as defined in claim 3 and comprising a gear coupling between each gear box and its associated ball screw, said gear coupling enabling deflection of said ball screw relative to its associated gear box.

14. The invention as defined in claim 1 and comprising means for threadably connecting said ball screws to said cradle and permit limited lateral deflection of said ball screws relative to said cradle.

15. The invention as defined in claim 1 wherein said cradle comprises a pair of spaced apart beam sections, said beam sections having a connected portion at each end, said ball screws being threadably connected to said connected portions of said cradle.

16. The invention as defined in claim 1 and comprising a plurality of guide rods secured to said base and slidably extending through receiving openings in said cradle.

17. A hemming machine comprising:

a base adapted to be supported on a ground support surface, hemming tooling mounted to said base, a cradle vertically slidably mounted to said base, a nest mounted to said cradle, said nest adapted to support a part to be hemmed, a first and second ball screw rotatably mounted to said base, said ball screws being threadably connected to said cradle on opposite sides of said nest so that rotation of said ball screws vertically displaces said cradle relative to said base, a single drive motor drivingly connected to both said first and second ball screws which rotatably drives the shafts in synchronism with each other, wherein said cradle comprises a pair of paced apart beam sections, said beam sections having a connected portion at each end, said ball screws being threadably connected to said connected portions of said cradle.

18. A hemming machine comprising:

a base adapted to be supported on a ground support surface, hemming tooling mounted to said base, a cradle vertically slidably mounted to said base, a nest mounted to said cradle, said nest adapted to support a part to be hemmed, a first and second ball screw rotatably mounted to said base, said ball screws being threadably connected to said cradle on opposite sides of said nest so that rotation of said ball screws vertically displaces said cradle relative to said base, a single drive motor drivingly connected to both said first and second ball screws which rotatably drives the shafts in synchronism with each other, wherein said interacting moving moans comprises at least on e pin on one of said nest and said hemming tooling and at least one socket on the other of said nest and said hemming tooling, said at least one pin engaging said at least one socket upon vertical movement of said nest relative to said hemming tooling.

19. The invention as defined in claim 18 wherein said at least one pin includes a tapered portion.

* * * * *